United States Patent [19]

Stone et al.

[11] Patent Number: 5,073,985

[45] Date of Patent: Dec. 24, 1991

[54] PROTECTIVE BODY ARMOR GARMENT SHELL

[75] Inventors: Richard Stone, Holbrook; David R. Hand, Kings Park, both of N.Y.

[73] Assignee: Point Blank Body Armor, Inc., Amityville, N.Y.

[21] Appl. No.: 601,267

[22] Filed: Oct. 22, 1990

[51] Int. Cl.[5] ..... F41H 1/02

[52] U.S. Cl. ..... 2/2.5; 2/92

[58] Field of Search ..... 2/2.5, 92, 102, 103, 2/94, DIG. 6, 2; 89/36.05

[56] References Cited

U.S. PATENT DOCUMENTS

| | | | |
|---|---|---|---|
| 1,163,094 | 12/1915 | Kurek | 2/2.5 |
| 1,739,112 | 12/1929 | Wisbrod | 2/102 |
| 2,076,076 | 4/1937 | Dunlap | 2/2.5 |
| 2,517,615 | 8/1950 | Webster et al. | 2/2.5 |
| 2,747,190 | 5/1956 | Foster | 2/2.5 |
| 3,452,362 | 7/1969 | Korolick et al. | 2/2.5 |
| 3,557,384 | 1/1971 | Barron et al. | 2/2.5 |
| 3,783,449 | 1/1974 | Davis | 2/2.5 |
| 3,891,996 | 7/1975 | Leach et al. | 2/2.5 |
| 4,266,297 | 5/1981 | Atkins | 2/2.5 |
| 4,466,135 | 8/1984 | Coppage, Jr. | 2/2.5 |
| 4,485,491 | 12/1984 | Rasmussen | 2/2.5 |
| 4,535,478 | 8/1985 | Züfle | 2/2.5 |
| 4,578,821 | 4/1986 | Zufle | 2/2.5 |
| 4,769,855 | 9/1988 | Tsai | 2/DIG. 6 |

OTHER PUBLICATIONS

Velcro Product News, Aug. 1976, PN No. 25, "Armored Vest", p. 2.

*Primary Examiner*—Werner H. Schroeder
*Assistant Examiner*—Amy Brooke Vanatta
*Attorney, Agent, or Firm*—McAulay Fisher Nissen Goldberg & Kiel

[57] ABSTRACT

A protective body armor garment shell is disclosed which has a front panel and a back panel made of a lightweight material and having features simulating a uniform shirt such that the garment shell can be worn over or in place of a standard uniform shirt and maintain a professional appearance while concealing the fact that body armor is being worn. The back panel is attached to the body utilizing a belt which firmly retains the garment to the body even when the front panel is loosely draped across the chest. The drapable feature allows a person wearing the garment to loosen the front panel to provide ventilation while maintaining the garment on the body, to maximize comfort.

12 Claims, 2 Drawing Sheets

PROTECTIVE BODY ARMOR GARMENT SHELL

TECHNICAL FIELD

This invention relates to protective body armor and more particularly to a garment shell for housing body armor which simulates a uniform garment.

BACKGROUND

Protective body armor panels, such as those disclosed in U.S. Pat. Nos. 4,660,223 and U.S. patent application Ser. No. 421,077 filed Oct. 13, 1989 titled "Improved Body Armor Insert", both commonly assigned herewith, are used to prevent injury from fire arms. Such panels either have various shoulder straps or belt portions to fasten the body armor to the body or are disposed in a vest like garment shell which includes the straps or belts.

Typically, there are two types of protective body armor worn by police officers One type is for entering known hazardous situations where the armor is worn over the officer's uniform together with other protective gear. The second type of body armor is worn doing routine duties such as patrolling, with the armor panels providing protection in unexpectedly hazardous situations. The second type of body armor is worn beneath the officer's uniform shirt to conceal it from individuals which the officer may confront. This concealment is an advantage in many situations. However, once the body armor is in place, it cannot be taken off or loosened until the officer's shift is completed.

The concealed types of body armor panels can become particularly uncomfortable in warm weather as the panels prevent ventilation of the body and restrict moisture removal. Since the body armor may not be worn in hot weather to avoid discomfort, this may place an officer at risk. Consequently, a need has arisen for concealable body armor which is convenient to wear, has a professional appearance and allows ventilation during performance of routine duties.

SUMMARY OF THE INVENTION

It is an object of the present invention to provide a body armor garment shell adapted for supporting body armor panels.

It is a further object to provide a garment shell which simulates an officers uniform garment, such as an officer's shirt, such that the garment can be worn over rather than under the officer's shirt, without losing the advantage of concealment.

It is a further object to provide a garment shell which has a drapable front panel to ease ventilation and comfort.

These and other objects to the present invention are achieved by providing a body armor garment shell having a front portion and a back portion and means for interconnecting said portions over the shoulders, and belt means extending from the back portion and being engagable beneath the front panel, to allow draping the front portion over the chest. Preferably, the front portion simulates a uniform garment. The garment shell also has releasable means for fixing the front portion to the back portion. The belt means, extending from the back portion, releasably secures the garment shell to the body to prevent garment shifting when the front portion is released from the back portion.

The garment shell is preferably made of a light weight cotton, polyester blend or such a material as used in a uniform shirt to simulate a shirt such that the shell can be worn over a standard uniform shirt or similar garment, simulating an officer's standard uniform. This provides the officer with a professional appearance and allows loosening of the front portion in non-hazardous conditions to improve comfort. The drapable feature of the front portion allows keeping the vest on and in place for rapid securement during the performance of routine duties.

DETAILED DESCRIPTION OF THE PREFERRED EMBODIMENTS

Figure 1:
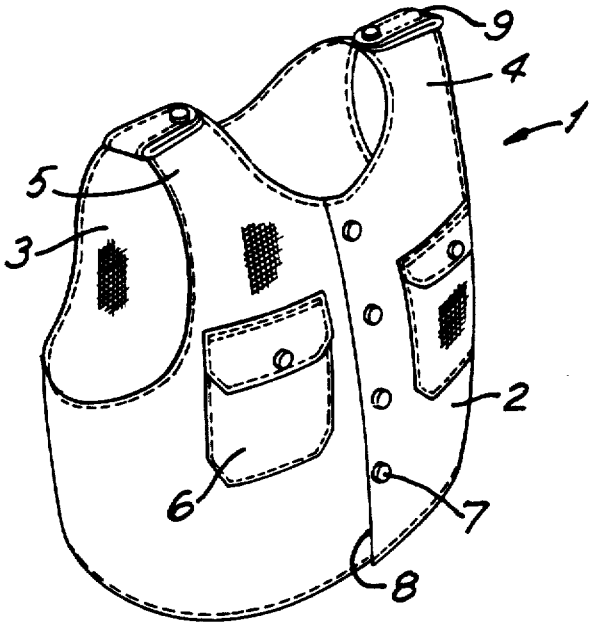
FIG. 1 is a perspective view of the inventive garment shell of the present invention.

Referring to FIG. 1 a protective body armor garment shell 1 is shown having a front portion 2 and a back portion 3 connected by shoulder straps 4 and 5. The garment shell includes pockets 6, buttons 7 adjacent a center seam 8 and epaulets 9 to simulate the appearance of a uniform shirt. Preferably, the garment shell is composed of a lightweight cotton, polyester or similar material essentially identical to that used to produce uniform style shirts. This allows the shell to match the texture and color as well as the appearance of the garment. However, the buttons 7 and seam 8 in this embodiment are merely a simulation and cannot be used to open the garment shell. The pockets may be real or simulated. Of course, additional simulated features, such as a shirt collar, sleeves, badge attaching grommets, etc., could also be added to the shell.

Figure 2:
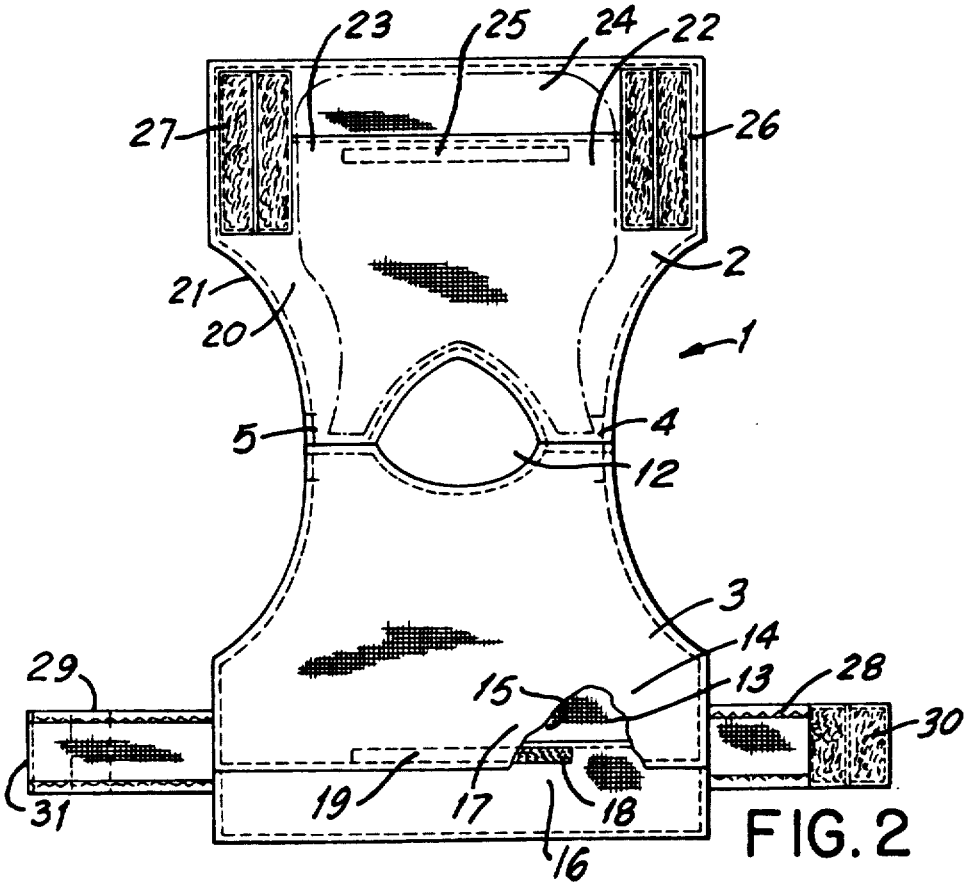
FIG. 2 is a view of the inner surfaces of the garment shell of FIG. 1, as provided prior to application to the body.

Referring to FIG. 2, the garment shell of FIG. 1 is shown in the open condition. The shoulder straps 4 and 5 connect the front and back portions 2 and 3, and form a head opening 12. The back portion 3 includes an inner layer 13 and an outer layer 14 forming a pocket 15 therebetween. A body armor panel (not shown) may be placed in the pocket 15. The inner layer has a lower section 16 partially overlaid by an upper section 17. An opening is provided between the overlaid sections. A pair of mating separable fasteners 18 and 19 are provided on opposite sides of the overlaid sections to maintain the sections in a closed condition. For illustrative purposes, the separable fasteners 18 and 19 are Velcro TM strips, which ease fastening and unfastening the opening. While Velcro TM strips are shown, other separable fasteners could be used with the present invention, for example, snaps or zippers.

The front panel 2 is similar to the back panel 3, having a pair of fabric layers 20 and 21 between which a protective body armor panel 22 is disposed (shown in phantom). The inner fabric layer has similar overlaid sections 23 and 24, having a pair of mated fasteners 25 to maintain the sections in a closed condition. The inner layer also includes a pair of side fasteners 26 and 27 along opposing lower sides thereof. Preferably, these fasteners are Velcro TM strips.

The back panel 3 has a pair of straps 28 and 29 which are engagable to form a belt. Each strap has a fastener, 30 and 31 respectively, provided at the ends thereof. Each fastener is of sufficient length to allow adjustment to conform to the waist of the user.

Figure 3:
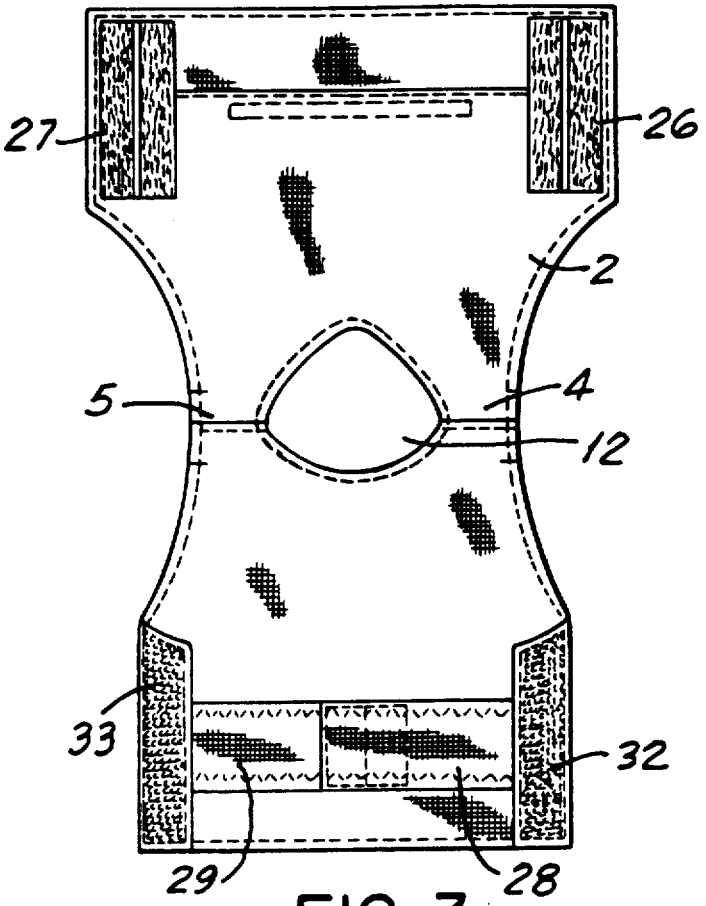
FIG. 3 is a view showing the garment shell of FIG. 2 with the belt means engaged for holding the shell to the body.

Referring to FIG. 3, the straps 28 and 29 are shown in the engaged position, with the fasteners 30 and 31 in contact. When the straps 28 and 29 are engaged, a pair of side fasteners 32 and 33 are exposed which are matable to the side fasteners 26 and 2 from the front panel. The side fasteners 32 and 33 are provided on the outer layer of the back panel. Thus, to don the garment shell, the front and back portions would be draped over the body, with the front portion placed over the chest. The straps 25, 29 would be fitted snugly to the waist and the fasteners 26 and 27 would be mated with the fasteners 32 and 33. The back panel is thus attached to the body using a belt which firmly retains the garment to the body even when the front panel is loosely draped across the chest. Preferably, Velcro TM strips are used as the fastening devices to allow rapid removal of the vest if necessary without fumbling with straps, buckles, clips or other attachment means.

Figure 4:
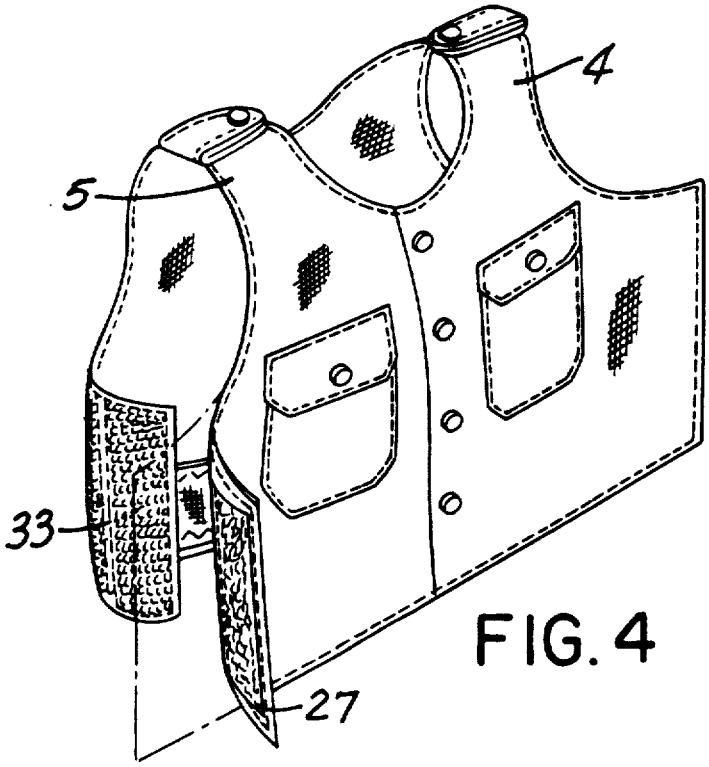
FIG. 4 is a perspective view showing the garment shell as it would be placed on the body, with the belt means engaged and the front panel being draped loosely for ventilation.

Referring to FIG. 4, the vest is shown as it would be utilized when ventilation is desired to increase comfort. The fasteners 26 and 27 would be disengaged from the fasteners 32 and 33, yet the belt would securely hold the garment shell to the person's body. Thus the front panel, being draped over the person's chest maintains the front panel body armor in a position to protect the chest. If necessary, the side fasteners would be engaged to provide a neat appearance. Since the garment simulates the appearance of a uniform shirt, the officer can maintain a professional appearance yet maximize protection and comfort. Also, if necessary the garment can be removed quite easily. If the officer is wearing a uniform shirt beneath this garment, he can operate free of the vest without having to disrobe. Similarly, the garment can be quickly applied over a shirt if necessary. This quick on and off feature overcomes a major inconvenience with previous body armor positioned beneath a uniform shirt and should increase the utilization of such garments.

Utilizing a lightweight garment which simulates a uniform shirt for holding protective body armor panels increases the ease with which body armor can be donned or doffed. In addition, protection is maximized as the protective body armor panels are still concealed from view. Since the officer's comfort is maximized, the utilization of protective body armor shall be greatly increased. Also, since body armor is known to be particularly uncomfortable in hot weather, the ability to loosen the front panel and allow ventilation should significantly increase comfort and again enhance utilization.

While preferred embodiments of the present invention have been shown and described it will be understood by those skilled in the art that various changes and modifications could be made without varying from scope of the present invention. For example while a particular simulated official garment has been disclosed, it will be understood by those skilled in the art that various other simulated garment features could be provided in place of those shown and still be within the scope of the present invention.

We claim:

1. A protective body armor garment shell comprising a front portion, a back portion, and means for interconnecting said portions over a persons shoulders, pocket means provided in the front and back portions for containing one or more body armor panels therein, and, belt means extending from the back or front portion for securing the back or front portion to the persons body, the belt means being engaged beneath the non-secured back or front portion, allowing the non-secured portion to drape over the body.

2. The garment shell of claim 1 further comprising attachment means for attaching the front portion releasably to the back portion at the persons sides.

3. The garment shell of claim 1 wherein the belt means extend from the back portion.

4. The garment shell of claim 1 wherein the belt means comprise a pair of straps having means for engaging to secure the garment shell to the persons body.

5. The garment shell of claim 1 wherein the front portion comprises a front layer and a back layer between which a pocket is formed, a protective body armor panel being disposable in the pocket.

6. The garment shell of claim 1 wherein the back portion comprises a front layer and a back layer between which a pocket is formed, a protective body armor panel being disposable in the pocket.

7. The garment shell of claim 1 wherein the garment shell has means for simulating the appearance of a uniform garment.

8. The garment shell of claim 7 wherein the front portion has buttons, epaulets and pockets to simulate a uniform garment appearance.

9. The garment shell of claim 2 wherein the attachment means are opposed fasteners which are disposable in a facing relationship on the front and back portions after placing the garment shell on the persons body.

10. The garment shell of claim 5 wherein the front layer has two overlaid sections which form an opening therebetween, the body panel being insertable or removable through said opening into said pocket.

11. The garment shell of claim 6 wherein the back layer has two overlaid sections which form an opening therebetween, the body panel being inserted or removed through the opening into the pocket.

12. A method for protecting a person comprising:

providing a protective garment shell having a front portion, a back portion, and means for inter-connecting the portions over a persons shoulders, and belt means extending from the back portion for securing the back portion to the persons body the belt means being engaged beneath the front portion, allowing the front portion to drape over the chest;

incorporating protective body armor panels in the garment shell and;

applying the garment shell to the persons body.

* * * * *